US009045205B2

(12) United States Patent
Lemme et al.

(10) Patent No.: US 9,045,205 B2
(45) Date of Patent: Jun. 2, 2015

(54) FLOATABLE BOAT RAMP

(71) Applicants: Jody L. Lemme, Arlington, SD (US); Todd M. Huntimer, Arlington, SD (US)

(72) Inventors: Jody L. Lemme, Arlington, SD (US); Todd M. Huntimer, Arlington, SD (US)

(73) Assignee: Global Polymer Industries, Inc., Madison, SD (US)

( * ) Notice: Subject to any disclaimer, the term of this patent is extended or adjusted under 35 U.S.C. 154(b) by 0 days.

(21) Appl. No.: 13/829,492

(22) Filed: Mar. 14, 2013

(65) Prior Publication Data

US 2014/0270959 A1 Sep. 18, 2014

(51) Int. Cl.
*B63C 3/02* (2006.01)
*E02C 3/00* (2006.01)

(52) U.S. Cl.
CPC .... *B63C 3/02* (2013.01); *E02C 3/00* (2013.01)

(58) Field of Classification Search
USPC ..... 405/1, 218, 221; 14/27
See application file for complete search history.

(56) References Cited

U.S. PATENT DOCUMENTS

| | | | | | |
|---|---|---|---|---|---|
| 175,019 | A * | 3/1876 | Borgfeldt | 441/35 |
| 1,900,319 | A * | 3/1933 | Vermeulen | 405/218 |
| 2,423,832 | A * | 7/1947 | Gearon | 14/27 |
| 2,564,951 | A * | 8/1951 | Blagden | 405/2 |
| 2,987,024 | A * | 6/1961 | Rush | 114/266 |
| 3,091,203 | A * | 5/1963 | Usab | 114/266 |
| 3,252,173 | A * | 5/1966 | Robinsky | 14/27 |
| 3,258,800 | A * | 7/1966 | Robinsky | 14/27 |
| 3,458,884 | A * | 8/1969 | Gurganious | 14/27 |
| 3,496,586 | A * | 2/1970 | Kaufman | 14/27 |
| 3,583,008 | A * | 6/1971 | Edwards | 5/655.3 |
| 3,622,073 | A * | 11/1971 | Cayre | 238/10 R |
| 3,999,879 | A * | 12/1976 | Stachiw et al. | 404/73 |
| 4,047,257 | A * | 9/1977 | Bondarchuk, Sr. | 14/27 |
| 4,964,751 | A * | 10/1990 | Rope et al. | 404/35 |
| 5,192,161 | A * | 3/1993 | Helgesson et al. | 405/26 |
| 5,400,733 | A * | 3/1995 | Richter | 114/258 |
| 5,529,012 | A * | 6/1996 | Rytand | 114/263 |
| 6,024,039 | A * | 2/2000 | Mack et al. | 114/218 |
| 6,588,358 | B1 * | 7/2003 | Reynolds | 114/264 |
| 7,708,497 | B2 * | 5/2010 | Wilcox | 405/219 |
| 8,087,373 | B2 * | 1/2012 | Mattson | 114/267 |

* cited by examiner

*Primary Examiner* — Tara M. Pinnock
(74) *Attorney, Agent, or Firm* — Lowe Graham Jones PLLC

(57) ABSTRACT

A floatable boat ramp is disclosed including a plurality of hollow planks arranged parallel to one another such that the upper surfaces thereof define a drivable surface. A plurality of flexible channels couple cavities defined by adjacent planks of the plurality of hollow planks to one another a first end plank defines one or more openings to allow inlet and outlet of air and water in order to cause the boat ramp to sink or float. The interior cavity of the planks may be divided into right and left hand portions. Left and right hand channels coupled the right and left hand portions, respectively, of adjacent planks to one another. A second end plank includes a continuous cavity and allows fluid communication between left and right hand portions of the other planks. The planks may be coupled together by cables extending through sleeves rotatably mounted to the ends thereof.

23 Claims, 7 Drawing Sheets

FLOATABLE BOAT RAMP

FIELD OF THE INVENTION

This application relates to methods and apparatuses for constructing boat ramps.

BACKGROUND OF THE INVENTION

Installing a boat ramp on a bank of a body of water is a complicated undertaking. Inasmuch as a portion of the ramp will be under water, one cannot simply place forms and pour concrete in the usual manner. In a typical installation, a boat ramp is formed of precast concrete planks that are placed on a slope extending into the water. The placement of these planks requires the use of heavy machinery, which may not be readily accessible on the bank of a body of water. Upon installation and over time, the cement planks may settle into the bank and floor of the body of water. As they do so, sand and other sediment is pushed out and the action of waves carries it away, thereby eroding the bank and floor of the body of water.

Once in place, the concrete planks are not readily removable. In addition to requiring the use of heavy machinery, removal may require digging out the concrete planks. Once removed, remediation of the bank and floor of the body of water may also be required due to settling of the planks and damage caused by the machinery used.

It would be an advancement in the art to provide an improved approach to the design and installation of boat ramps that would reduce bank erosion or provide for ready removal.

SUMMARY OF THE INVENTION

In one aspect of the invention, a boat ramp includes a plurality of hollow planks coupled to one another such that upper surfaces thereof define a drivable surface. Channels extend between adjacent planks of the plurality of hollow planks effective to enable fluid communication between the adjacent planks. The plurality of channels may include a flexible material. The plurality of hollow planks may also be coupled to one another by means of first and second cables each engaging first and second ends, respectively, of each of the plurality of hollow planks. For example, sleeves may be mounted to the first and second ends of the plurality of hollow planks in a fixed or rotatable manner. A first cable extends through the sleeves secured to the first ends and a second cable extends through the sleeves secured to the second ends.

In one aspect of the invention fluid vessels are used for the right amount of buoyancy in conjunction with planks on top of at least some of the vessels. Preferably the planks form the top wall of the vessels.

In another aspect of the invention, the sleeves each have a post secured thereto and the first and second ends of the plurality of hollow planks include brackets defining an aperture having the post secured therein. A wear pad, such as a ultra high molecular weight (UHMW) pad, may secure to the bracket. The wear pad may be positioned around the aperture and be interposed between the bracket and a head of the post. Wear pads, such as UHMW pads may also be mounted to the first and second pluralities of sleeves and be positioned around the post between the sleeve and the bracket.

In another aspect of the invention, the hollow planks include a number of internal stiffening elements. The stiffening elements may include cutouts or be otherwise shaped to allow fluid flow there around.

In another aspect of the invention, barriers, which may be stiffening plates, may divide the plurality of planks into left and right hand portions. Right hand channels may couple right hand portions of adjacent planks to one another and left hand channels couple left hand portions of adjacent planks to one another. An end plank may lack a barrier and provide a channel for fluid flow between the right hand portions and the left hand portions.

In use, at least a portion of the plurality of hollow planks is filled at least partially with water. For example, at least a portion of the plurality of hollow planks may be at least half-full of water, preferably between 90 and 100 percent full of water. Since the planks are filled with water, when a wave strikes them, the planks transfer the wave energy through them and slightly shift to stay on top of the sand.

Methods for using the boat ramp are also disclosed and claimed herein.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
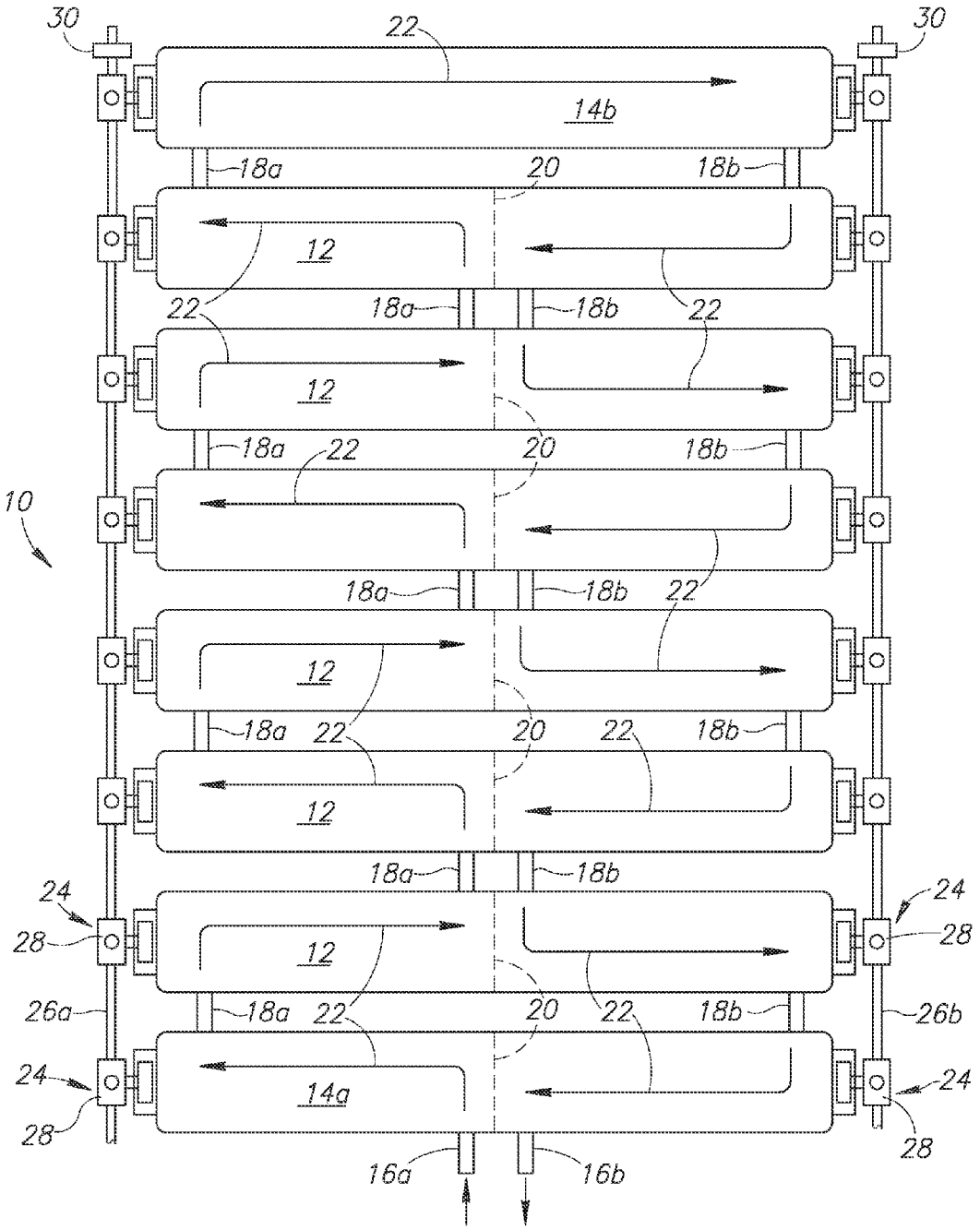
FIG. 1 is a top plan view of a floatable boat ramp in accordance with an embodiment of the present invention.

Referring to FIG. 1, a boat ramp 10 may include a plurality of planks 12. The planks 12 are hollow such that the material defining an outer surface of the plank 12 does not occupy a major portion of the interior volume of the planks 12. In some embodiments, the thickness of the walls of the plank 12 may be sufficient to provide structural strength for bearing vehicles driven over the plank 12, such as boat trailers holding boats and a vehicle towing a boat trailer. In one embodiment, the planks 12 are formed of steel in another the planks 12 are formed of a high strength polymer or composite material (e.g. fiberglass or carbon fiber composite) of sufficient thickness to support a vehicle driven thereon. In one preferred embodiment, the planks are made of aluminum. Alternatively the planks may be made of concrete or plastic. The interior volume of the plank 12 may be empty or may be occupied by other structures such as stiffening elements. The interior volume of the plank 12 may also be completely or partially occupied by a porous or meshed material to hinder sloshing of water within the plank 12. Depending on the density of the plank material relative to the density of water, the planks may be either partially or fully filled with water. So, for example, if the planks are made of steel, more air may be left in the planks than if the planks are made of aluminum, plastic, or composites.

The planks 12 are joined together as shown to form a drivable surface. An upper surface of the planks 12 may be textured, coated, or have grip enhancing structures secured thereto in order to provide traction to a vehicle driven thereon. The upper surfaces of the planks 12 may be substantially flat, such as for a plank 12 with a rectangular cross section. However, the upper surfaces of the planks 12 may also be slightly rounded or have some other shape. As shown, the planks 12 are placed adjacent one another having the longitudinal axes thereof parallel to and offset from one another. The longitudinal axes of the planks 12 may be perpendicular to a direction of travel along the planks 12 as shown in FIG. 1 or parallel thereto in other embodiments.

In some embodiments, each plank 12 may define openings that are selectively openable to permit inlet and outlet of water and air. In the illustrated embodiment, the planks are coupled to one another to form both a drivable surface and a continuous channel. For example, a plurality of planks 12 may be arranged in a row adjacent to one another having the longitudinal axes thereof parallel to and offset from one another. The planks 12 are positioned between end planks 14*a*, 14*b*. An end plank 14*a* defines at least one opening 16*a*, preferably two openings 16*a*, 16*b*. A second end plank 14*b* is located at an opposite end from the end plank 14*a*. Each plank of the planks 12, 14*a*, 14*b* is secured to any adjacent planks by means of channels. In the illustrated embodiment, the channels include left channels 18*a* and right channels 18*b*. The planks 12 and 14*a* may further include a barrier 20 secured between right and left hand portions thereof, such that one or more points of entry for left channels 18*a* are on one side of the barrier 20 and are isolated from the other side of the barrier 20 that defines one or more points of entry for the right channels 18*b*.

In the illustrated embodiment, the end plank 14*b* (the plank preferably placed furthest from the shore) does not include a barrier 20 and provides a duct for fluid communication from the left hand portions of the planks 12 and the right hand portions thereof. For example, as shown by the flows 22, water or air input through the opening 16*a* in a left hand portion of the plank 14*a* will flow through the left hand portions of the planks 12, through the left channels 18*a* to the end plank 14*b*. The water or air will then flow out of the end plank 14*b*, through the right hand portions of the planks 12, through the right channels 18*b*, and out of the opening 16*b* formed in the right hand portion of the plank 14*a*.

In use, water may be pumped into the aperture 16*a* and air displaced thereby allowed to escape through the aperture 16*b*, or vice versa, when sinking the boat ramp 10 during installation. To facilitate removal of the boat ramp 10, air may be pumped into the aperture 16*a* to purge water out through the aperture 16*b*, or vice versa, when removing the boat ramp 10.

Any method known in the art may be used to couple the planks 12, 14*a*, 14*b* to one another. In some embodiments, the tubes defining the channels 18*a*, 18*b* may be of sufficient strength to couple the planks 12, 14*a*, 14*b* together. The planks 12, 14*a*, 14*b* may also be secured to one another by hinges or other flexible structure. A flexible coupling between the planks allows them to "snake" into the water as some planks start to sink as they are filled with water or some planks start to rise as they are removed by filling with air. In the illustrated embodiment, couplers 24 secure to each end of each planks 12, 14*a*, 14*b* either rigidly or rotatable about an axis parallel to a longitudinal axis of the planks 12, 14*a*, 14*b*. A left cable 26*a* and a right cable 26*b* engage the couplers 24 on the left and right hand sides, respectively, of the planks 12, 14*a*, 14*b*. In the illustrated embodiment, the couplers 24 are sleeves 28 secured to ends of the planks 12, 14*a*, 14*b* and the cables 26*a*, 26*b* extend through the sleeves 28 on each side of the planks 12, 14*a*, 14*b*. The cables 26*a*, 26*b* may be free to slide within the sleeves 28 or sliding may be hindered or prevented, such as by means of a setscrew or other retention device. Where the sleeves 28 are not prevented from sliding along the cables 26*a*, 26*b*, stops 30 may be fastened to end portions of the cables 26*a*, 26*b*, e.g. distal of the end plank 14*b*. The stops 30 may be of sufficient width to prevent sliding of the sleeves 28 thereover.

Figure 2:
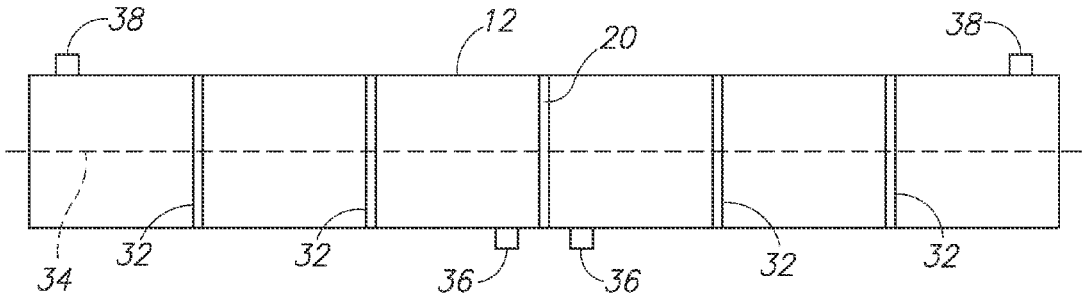
FIG. 2 is a top plan view of a plank suitable for use in a floatable boat ramp in accordance with an embodiment of the present invention.

Referring to FIG. 2, a plank 12 (or planks 14*a*, 14*b* from FIG. 1) may be as shown. In addition to the barrier 20 in the center, one or more stiffeners 32 may be secured within an inner cavity defined by the plank 12. For example, stiffeners 32 may be plates perpendicular to a longitudinal axis 34 of the plank 12. The stiffeners 32 may be secured within the planks 12 by means of welding, screws, bolts, or other fastening means. Where the plank 12 is formed of a polymer material, the stiffeners 32 may be monolithically molded with the walls of the plank 12. The end planks 14*a*, 14*b* may likewise include stiffeners 32. As already noted an end plank 14*b* may lack a central barrier 20.

As noted with respect to FIG. 1, a plurality of channels 18*a*, 18*b* may facilitate fluid flow between adjacent planks 12, 14*a*, 14*b*. A plank 12, 14*a*, 14*b* may therefore define ports for coupling to the channels 18*a*, 18*b*. In the illustrated embodiments, the ports include medial ports 36 and lateral ports 38. For example, one side of the plank 12 may define medial ports 36 and the opposite side of the plank 12 may define lateral ports 38, where the lateral ports 38 are closer to the ends of the plank 12 than the medial ports 36. The end plank 14*b* may define only one of medial ports 36 and lateral ports 38 on only one side thereof. In the illustrated embodiment, a lateral port 38 is located longitudinally between an end of a plank 12, 14*a*, 14*b* and the stiffener 32 closest to that end. Also in the illustrated embodiment, a medial port 36 is located longitudinally between the barrier 20 and a stiffener 32 closest to the barrier 20.

Figure 3:
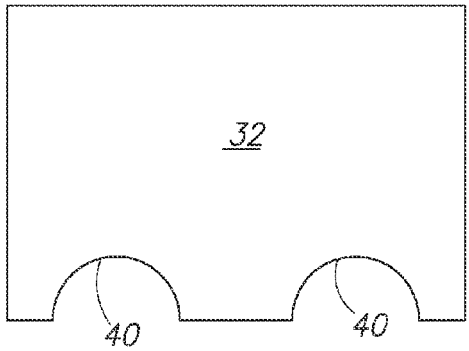
FIG. 3 is a side elevation view of a stiffening element suitable for use in a plank in accordance with an embodiment of the present invention.

Referring to FIG. 3, the stiffeners 32 may have any perimeter shape effective to engage the walls of an interior cavity defined by a plank 12, 14*a*, 14*b*. The stiffener 32 may additionally define one or more cutouts 40 or apertures 40 to facilitate flow of air and water around the stiffener 32. The cutouts 40 may be located near or at a lower edge of the stiffener 32, such that air forced into the plank 12, 14*a*, 14*b* will tend to urge water through the cutouts 40.

Figure 4:
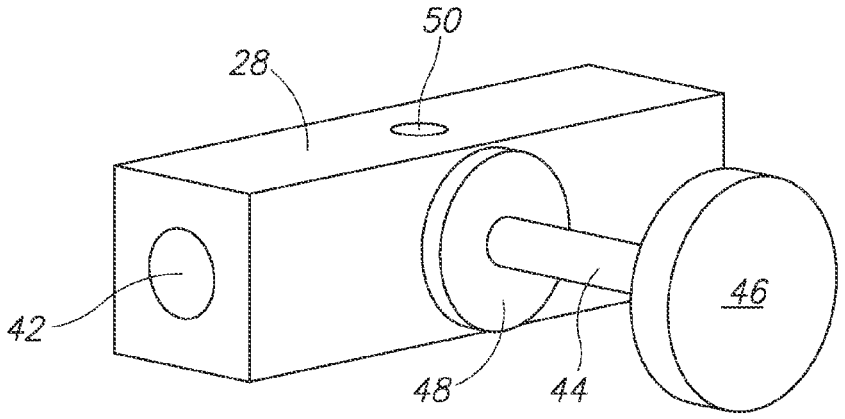
FIG. 4 is an isometric view of a sleeve for securing planks to one another in a floatable boat ramp in accordance with an embodiment of the present invention.

FIG. 4 illustrates a sleeve 28 suitable for use in the boat ramp 10 of FIG. 1. The sleeve 28 defines an aperture 42 extending therethrough and sized to receive a cable 26*a*, 26*b* (shown in FIG. 1). A post 44 may be secured to the sleeve 28 and extend away therefrom. In the illustrated embodiment, a center axis of the post 44 is perpendicular to a center axis of the aperture 42. A head 46 is secured to a distal end of the post 44. In some embodiments, a wear pad 48 may encircle the post 44 and be positioned adjacent the sleeve 28, such as due to securement to the sleeve 28. The wear pad 48 may be formed of a material that one or both of provides cushioning and reduces wear due to friction, such as a polymer material. For example, in one preferred embodiment the wear pad 48 is formed of an ultra high molecular weight (UHMW) polymer.

The post 44 may be secured to the sleeve 28 in a removable or non-removable fashion. For example, the sleeve 28 may define a threaded aperture 50 to receive a setscrew that engages the post 44. Alternatively or additionally, a setscrew secured in the aperture 50 may engage a cable 26*a*, 26*b* to hinder movement of the sleeve 28 relative to the cable 26*a*, 26*b*. In a like manner, a post head 46 may be permanently secured to the post 44 by means of welds or monolithic formation therewith. The post head 46 may also secure to the post 44 by means of threaded engagement with the post 44 or other removable fastening means.

Figure 5:
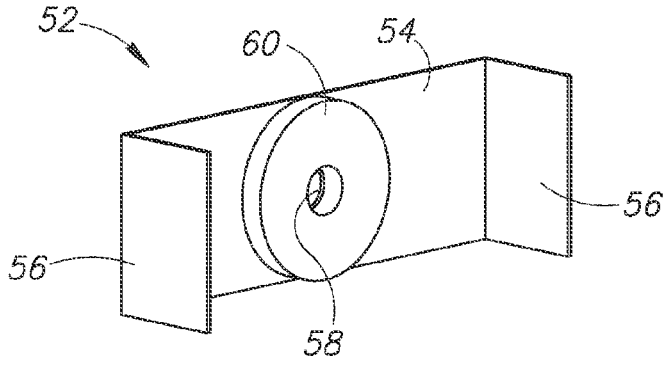
FIG. 5 is an isometric view of a bracket for securing to a plank of a floatable boat ramp in accordance with an embodiment of the present invention.

FIG. 5 illustrates a bracket 52 that may engage the post 44 and post head 46 of FIG. 4. The bracket 52 may be secured to an end or end portion of a plank 12, 14*a*, 14*b*. The bracket 52 may include an offset plate 54 and one or more legs 56 secured to the offset plate 54 or formed monolithically therewith. In the illustrated embodiment, the legs 56 extend perpendicularly away from the offset plate 54. A distal edge or end portion the legs 56 is secured to the end or end portion of a plank 12, 14*a*, 14*b* such that the plate 54 is offset sufficient to provide room for the post head 46 and any wear pads, as well as sufficient clearance to provide rotation.

The bracket 52 may define an aperture 58, such as in the offset plate 54, for receiving the post 44. A wear pad 60 may secure to the offset plate 54 around the aperture 58. The wear pad 60 may be formed of a material that one or both of provides cushioning and reduces wear due to friction, such as a polymer material. For example, in one preferred embodiment the wear pad 60 is formed of an ultra high molecular weight (UHMW) polymer. In use, the wear pad 60 is positioned between the head 46 of the post 44 and the offset plate 54. The wear pad 48 may be positioned between the sleeve 28 and the offset plate 54 in when the sleeve 28 and bracket 52 are assembled.

Referring to both FIGS. 4 and 5, securement of the sleeve 28 to a plank 12, 14*a*, 14*b* may proceed in any order. For example, the head 46 may be secured to, or formed with, the post 44 and the post 44 inserted through the aperture 58. The bracket 52 may then be secured to the plank 12, 14*a*, 14*b* and the sleeve 28 secured to the post 44. The sleeves 28 may be secured to the ends of each plank 12, 14*a*, 14*b* prior to mounting to a cable 26*a*, 26*b* within the sleeves 28. In this manner the planks 12, 14*a*, 14*b* may be assembled prior to installation in a fabrication facility and then threaded onto a pair of cables 26*a*, 26*b* to form a boat ramp of an appropriate length.

Figure 6A:
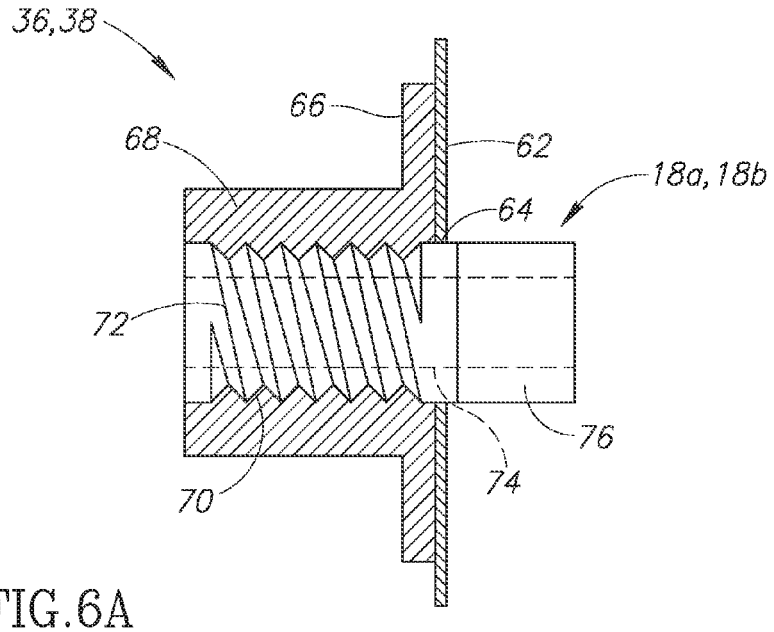
FIGS. 6A-6C are side cross-sectional views of ports of a plank of a floatable boat ramp in accordance with an embodiment of the present invention.
Figure 6B:
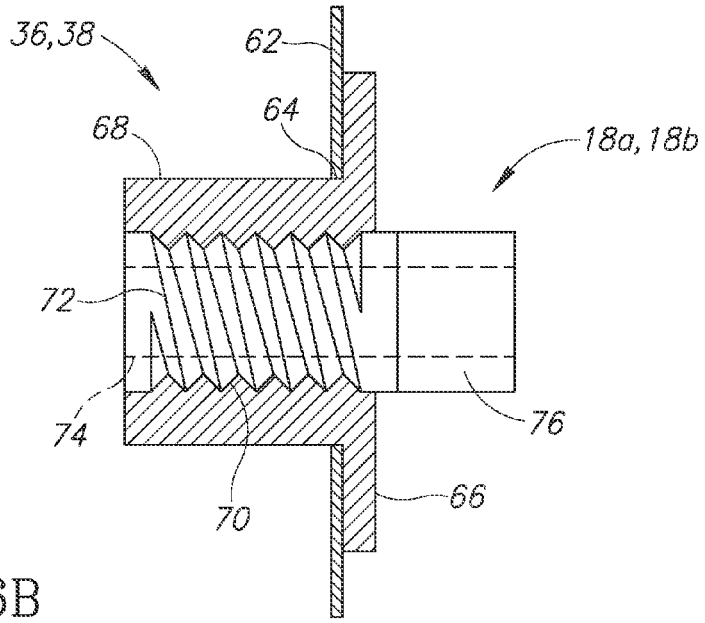
Figure 6C:
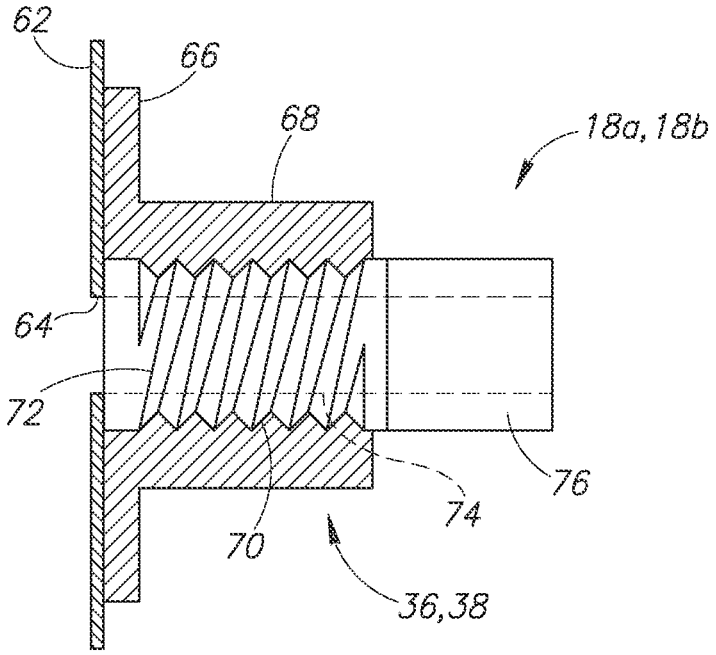

Referring to FIGS. 6A-6C, a port 36, 38 may be defined in a plank 12, 14*a*, 14*b* by any means known in the art. In one embodiment, channels 18*a*, 18*b* may be embodied as sections of hydraulic hose or other hose type of sufficient toughness and flexibility. In a similar manner, the ports 36, 38 may be implemented using hydraulic fittings. For example, a wall 62 of a plank 12, 14*a*, 14*b* may define an aperture 64. A hydraulic fitting may secure to the wall 62 proximate the aperture. For example, a fitting may include a flange 66 that encircles the aperture 64 and secures to the wall 62 by means of welds, adhesive, rivets, threaded fasteners, or other means. A threaded tube 68 secures to the flange 66, such as due to monolithic formation with the flange 66 or by means of welds or other fasteners.

The threaded tube 68 defines a channel 70 that is aligned with or substantially overlaps the aperture 64. The threads of the threaded tube 68 may be internal threads or external threads. A hydraulic hose may secure to the threaded tube 68. For example, a threaded portion 72 defining a channel 74 may be secured to a hose 76 implementing a channel 18*a*, 18*b*. The threaded portion 72 may be formed of a metal or rigid polymer and the hose 76 may be formed of a resilient polymer that may be reinforced with fibers or metal wires. The threaded portion 72 may be engaged with the threaded tube 68 in order to mount the hose 76 the wall 62 of a plank 12, 14*a*, 14*b*.

In some embodiments, rather than threads, the threaded tube 68 may define cylindrical barbs over which a polymer hose 76 may be forced. The resilience of the hose 76 will maintain the hose 76 in engagement with the cylindrical barbs and resist removal. In a like manner the hose 76 may secure to the threaded portion 72 by means of cylindrical barbs formed thereon as known in the art.

As shown in FIGS. 6A through 6C, the flange 66 and threaded portion 68 may have various positions and orientations with respect to the wall 62 of a plank 12, 14*a*, 14*b*. As shown in FIG. 6A, the flange 66 and threaded portion 68 may be positioned entirely inside the cavity defined by a hollow plank 12, 14*a*, 14*b*. As shown in FIG. 6B, the flange 66 may be secured within the cavity defined by a hollow plank 12, 14*a*, 14*b* and the threaded portion 68 may protrude outside of the cavity. As shown in FIG. 6C, the flange 66 and threaded portion 68 may both be located entirely outside of the cavity defined by a hollow plank 12, 14*a*, 14*b*.

Figure 7A:
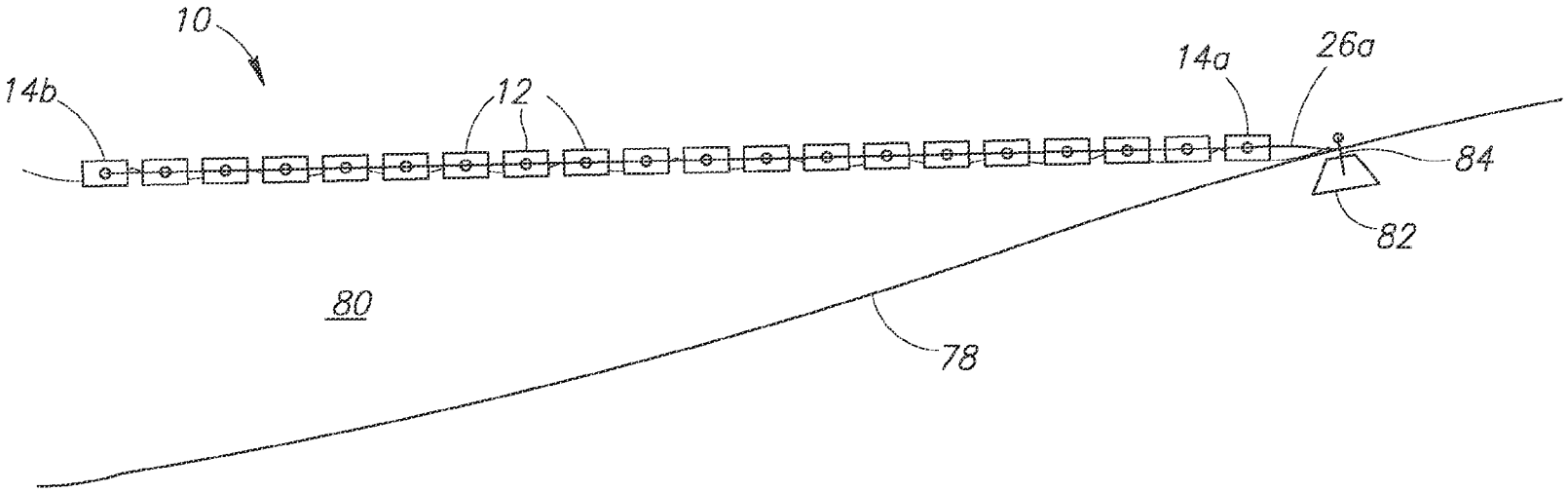
FIGS. 7A and 7B are side elevation views of a floatable boat ramp deployed on a slope in accordance with an embodiment of the present invention.

Referring to FIG. 7A, in order to deploy the boat ramp 10 on a slope 78 forming the bank and floor of a body of water 80, the planks 12, 14*a*, 14*b* may be filled with air such that they float at or near the surface of the water 80. Where the planks 12, 14*a*, 14*b* are being used for the first time pumping out water is not necessary, where the planks 12, 14*a*, 14*b* are being redeployed, water may be completely or partially purged from the planks 12, 14*a*, 14*b* such that they float at or near the surface of the water 80. Once floating in the water, the boat ramp 10 may be easily positioned and oriented as desired over the slope 78. The cables 26*a*, 26*b* coupling the planks 12, 14*a*, 14*b* together may be anchored on the slope 78, such as by means of an anchor 82 made of concrete or some other structure buried in the slope 78. For example, a pin 84 embedded in the anchor or driven into the slope 78 may fasten to a cable 26*a*, 26*b*. In some embodiments, the number of planks 12 may be sufficient such that when the planks 12 are filled with water the boat ramp 10 does not move during normal use and when exposed to waves and currents of the water 80. In such embodiments, anchors 82 and pins 84 may not be needed to retain the boat ramp 10.

Figure 7B:
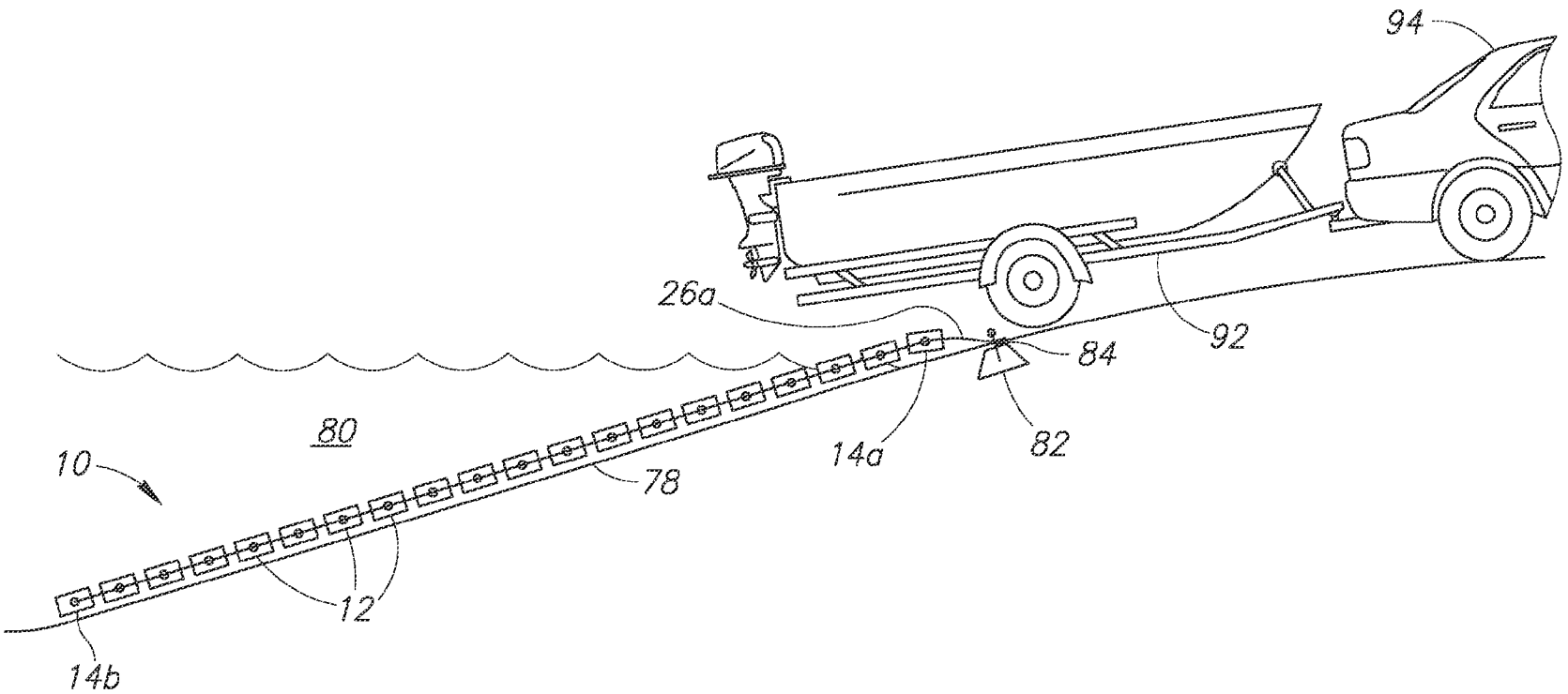

Referring to FIG. 7B, once in position, some or all of the planks 12, 14*a*, 14*b* of the boat ramp 10 that are over the water 80 may be completely or partially filled with water such that the some of the planks 12 and plank 14*b* sink onto the slope 78 or are floating a small distance above the slope 78. As explained hereinabove, sinking of the boat ramp 10 may be accomplished by pumping water into one of the openings 16*a*, 16*b* (FIG. 1), or allowing water to enter one of the openings 16*a*, 16*b*, and allowing air to escape through the other of the openings 16*a*, 16*b*.

In some embodiments, depending on the density of the plank material and other structure, the planks 12, 14*b* are not completely full of water such that they are neutrally buoyant or otherwise press down less on the slope 78 than would otherwise be the case. In this manner, rather than settle into the sand or sediment, the planks 12, 14*b* may rest lightly on the surface of the sand or be suspended due to near-neutral buoyancy above the slope 78. In this manner, erosion and damage of the slope 78 is reduced. For example, a portion of the planks 12 in the water 80 may be at least half-full of water. In a preferred embodiment, at least some of the planks 12 in the water 80 are between 90 and 99 percent (or essentially 100%) full of water by volume. In some embodiments, planks 12, 14*a* that are not in the water 80 may also be partially or completely filled with water in the same manner as for planks 12, 14*b* in the water 80. Filling planks 12, 14*a* on the slope 78 but not in the water 80 may prevent shifting and movement of these planks 12, 14*a*. Achieving a plank density only slightly greater than the water density tends to keep the planks on top of the bed surface (sand, etc) of the body of water such that wave action shifts the sand beneath the planks rather than buries the planks under the sand.

Besides the density being a factor in avoiding the planks becoming buried under the bed surface of a body of water, the fact that the planks are filled with water helps to keep them from settling under the bed surface. As a wave strikes the submerged planks or vessels, the wave energy is transferred through the planks causing them to slightly snake or shift on the bed of the body of water. This wave action (energy transfer) through fluid in the planks or vessels helps keep the planks from sinking into the ground (sand, etc.).

Once installed, a trailer 92 for transporting watercraft may then be impelled up and down the boat ramp 10. In some embodiments, the boat ramp 10 may also support a towing vehicle 94 coupled to a trailer 92. In some embodiments, the planks 12, 14*a*, 14*b* may be lightweight and therefore unsuitable for larger watercraft and vehicles. However, in such embodiments, the portability and ease of installation of the disclosed boat ramp 10 may advantageously enable the use of relatively large watercraft (e.g. those not transportable by hand) in bodies of water that are undeveloped or inaccessible by equipment used to install conventional boat ramps. In other embodiments, the planks 12, 14*a*, 14*b* may of sufficient strength and size to accommodate any boat that could be towed on public roads and vehicles for towing such boats.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A boat ramp comprising:

a plurality of hollow planks coupled to one another such that upper surfaces thereof define a drivable surface;

a plurality of channels each extending between adjacent planks of the plurality of hollow planks effective to enable fluid communication between the adjacent planks, wherein the plurality of hollow planks are coupled to one another by means of first and second cables each engaging first and second ends, respectively, of each of the plurality of hollow planks;

a first plurality of sleeves rotatably coupled to the first ends of the plurality of hollow planks;

a second plurality of sleeves rotatably coupled to the second ends of the plurality of hollow planks; and wherein the first cable extends through the first plurality of sleeves and the second cable extends through the second plurality of sleeves.

2. The boat ramp of claim 1, wherein the plurality of channels are formed of a flexible material.

3. The boat ramp of claim 1, further comprising:

first and second pluralities of sleeves each having a post secured thereto; and first and second pluralities of brackets each defining an aperture and secured to the first and second ends, respectively of the plurality of hollow planks;

wherein the first cable extends through the first plurality of sleeves and the second cable extends through the second plurality of sleeves; and wherein the posts of the first and second pluralities of sleeves are secured within the apertures of the first and second pluralities of brackets, respectively.

4. The boat ramp of claim 3, further comprising first ultra-high molecular weight (UHMW) pads mounted to the first and second brackets around the apertures thereof.

5. The boat ramp of claim 4, further comprising second UHMW pads mounted to the first and second pluralities of sleeves encircling the posts thereof.

6. The boat ramp of claim 1, wherein the plurality of hollow planks each further comprise one or more stiffening plates mounted therein, the one or more stiffening plates defining cutaway portions for allowing fluid flow therearound.

7. The boat ramp of claim 1, wherein the plurality of channels further comprise:

right hand channels each extending between right hand portions of adjacent planks of the plurality of hollow planks; and left hand channels each extending between left hand portions of adjacent planks of the plurality of hollow planks;

wherein each plank of the plurality of hollow further comprises a stiffening plate mounted therein, the stiffening plate isolating the left hand portion from the right hand portion of the each plank.

8. The boat ramp of claim 7, further comprising a terminal hollow plank coupled to a first end plank of the plurality of hollow planks, the terminal hollow plank not including a stiffening plate isolating left and right hand portions thereof;

wherein a left hand channel of the plurality of left hand channels couples the left hand portion of the first end plank to the terminal hollow plank and a right hand channel of the plurality of right hand channels couples the right hand portion of the first end plank to the terminal hollow plank; and wherein a second end plank of the plurality of hollow planks opposite the first end plank includes a right hand opening in the right hand portion thereof and a left hand opening in the left hand portion thereof.

9. The boat ramp of claim 1, wherein at least a portion of the plurality of hollow planks is at least half full of water.

10. The boat ramp of claim 1, wherein at least a portion of the plurality of hollow planks are between 80 and 95 percent full of water.

11. A method for building a boat ramp comprising:

joining a plurality of hollow planks to one another such that upper surfaces thereof define a drivable surface;

positioning the plurality of hollow planks on a bank of a body of water having a portion of the plurality of hollow planks floating on the body of water; and filling the portion of the plurality of hollow planks at least partially with water effective to sink the portion of the plurality of hollow planks below a surface of the body of water;

providing a plurality of channels coupling adjacent planks of the plurality of hollow planks;

providing first and second apertures in an end plank of the plurality of hollow planks; and purging water from the plurality of hollow planks through the second aperture by pumping air into the first aperture.

12. The method of claim 11, wherein filling the portion of the plurality of hollow planks at least partially with water comprises filling the portion of the plurality of planks with water until they rest on a floor of the body of water.

13. The method of claim 11, wherein filling the portion of the plurality of hollow planks at least partially with water comprises filling the portion of the plurality planks between 80 and 95 percent full of water.

14. The method of claim 11, further comprising:

purging water from the portion of the plurality of hollow planks; and removing the plurality of hollow planks from the body of water.

15. The method of claim 11, wherein joining the plurality of hollow planks to one another further comprises:

coupling a first cable to first ends of the plurality of hollow planks; and coupling a second cable to second ends of the plurality of hollow planks.

16. The method of claim 11, wherein joining the plurality of hollow planks to one another further comprises:

providing first plurality of sleeves secured to first ends of the plurality of hollow planks;

providing second plurality sleeves secured to the second ends of the plurality of hollow planks;

positioning a first cable in the first plurality of sleeves; and positioning a second cable in the second plurality sleeves.

17. The method of claim 16, wherein the first and second pluralities of sleeves are rotatably mounted to the first and second ends, respectively, of the plurality of hollow planks.

18. A boat ramp comprising:

a plurality of planks coupled to one another such that upper surfaces thereof define a drivable surface;

a plurality of vessels for containing fluid secured to the planks; and a plurality of channels each extending between adjacent vessels effective to enable fluid communication between the adjacent vessels;

wherein the planks are hollow and contain the plurality of vessels, the planks being coupled to one another by means of first and second cables each engaging first and second ends, respectively, of each of the plurality of hollow planks.

19. The boat ramp of claim 18, wherein the plurality of channels are formed of a flexible material.

20. The boat ramp of claim 18, wherein the vessels each further comprise one or more stiffening plates mounted therein, the one or more stiffening plates defining cutaway portions for allowing fluid flow therearound.

21. The boat ramp of claim 18, wherein the plurality of channels further comprise:

right hand channels each extending between right hand portions of adjacent vessels of the plurality of vessels; and left hand channels each extending between left hand portions of adjacent vessels of the plurality of vessels;

wherein each vessel further comprises a stiffening plate mounted therein, the stiffening plate isolating the left hand portion from the right hand portion of the each vessel.

22. The boat ramp of claim 18, wherein at least some of the planks are on top of at least some of the vessels.

23. The boat ramp of claim 22, wherein the planks that are on top of the vessels form upper walls of the vessels.

* * * * *